US007896270B2

(12) United States Patent
Sharp

(10) Patent No.: US 7,896,270 B2
(45) Date of Patent: Mar. 1, 2011

(54) DRUMS FOR HOGGING APPARATUS

(75) Inventor: Rodney Warwick Sharp, Hamilton (NZ)

(73) Assignee: Progressive IP Limited, Hamilton (NZ)

( * ) Notice: Subject to any disclaimer, the term of this patent is extended or adjusted under 35 U.S.C. 154(b) by 346 days.

(21) Appl. No.: 11/817,505

(22) PCT Filed: Mar. 1, 2006

(86) PCT No.: PCT/NZ2006/000034

§ 371 (c)(1),
(2), (4) Date: Jun. 11, 2008

(87) PCT Pub. No.: WO2006/093421

PCT Pub. Date: Sep. 8, 2006

(65) Prior Publication Data

US 2009/0045273 A1 Feb. 19, 2009

(30) Foreign Application Priority Data

Mar. 1, 2005 (NZ) ..... 538557

(51) Int. Cl.
*B02C 18/16* (2006.01)

(52) U.S. Cl. ..... 241/81; 241/242; 241/235

(58) Field of Classification Search ..... 241/81, 241/235, 242, 101.76, 222
See application file for complete search history.

(56) References Cited

U.S. PATENT DOCUMENTS

| | | | | |
|---|---|---|---|---|
| 4,687,144 | A | 8/1987 | Irwin et al. | |
| 5,118,043 | A * | 6/1992 | Marklund et al. | 241/24.1 |
| 5,267,603 | A * | 12/1993 | Didion | 164/404 |
| 5,613,902 | A * | 3/1997 | Didion et al. | 451/326 |
| 5,794,865 | A * | 8/1998 | Didion et al. | 241/74 |

FOREIGN PATENT DOCUMENTS

| | | |
|---|---|---|
| AU | 2005201329 | 10/2005 |
| GB | 2186504 | 8/1987 |
| WO | 2005/092509 | 10/2005 |

* cited by examiner

*Primary Examiner*—Faye Francis
(74) *Attorney, Agent, or Firm*—Young & Thompson

(57) ABSTRACT

A hogger and reducing apparatus and considers issues associated with fibrous other materials clogging screening apertures A paddle arrangement having an open framework rotates relative to the screening apertures provided on a drum. Either or both the paddle arrangement and drum may rotate, the resultant action increasing agitation of raw material (being reduced in size by a reducing means) in the vicinity of the screening apertures and also providing a wiping type effect to help clear material from within the apertures.

34 Claims, 6 Drawing Sheets

Figure 5
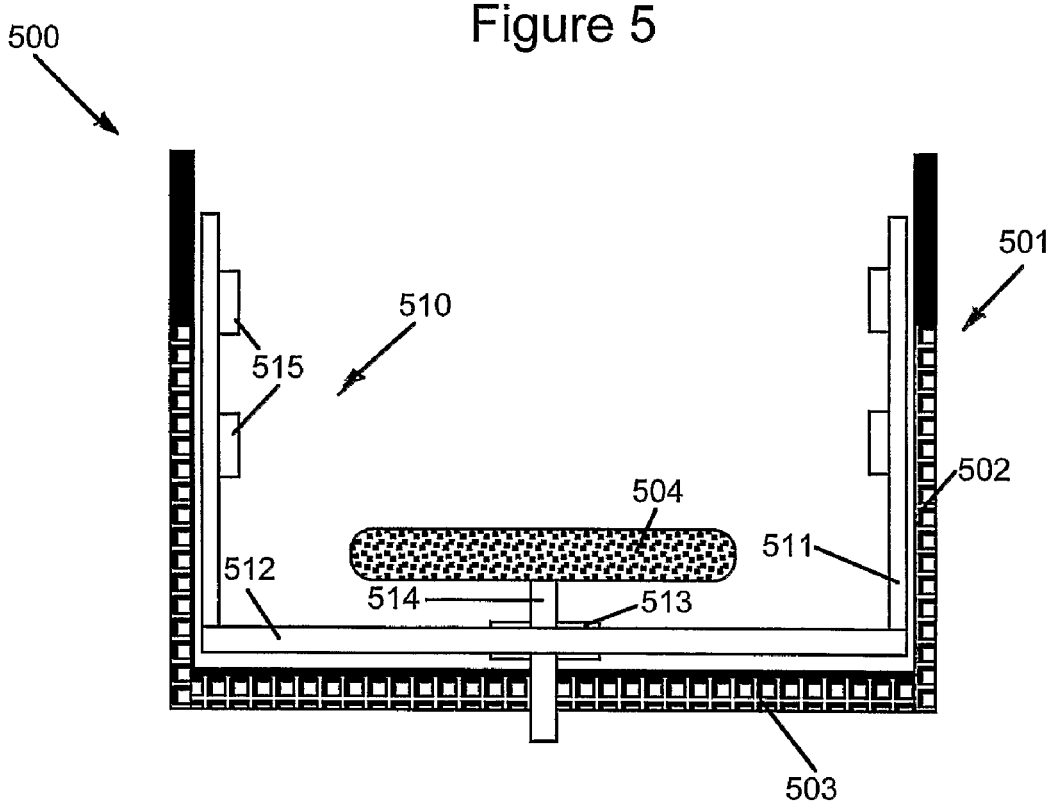
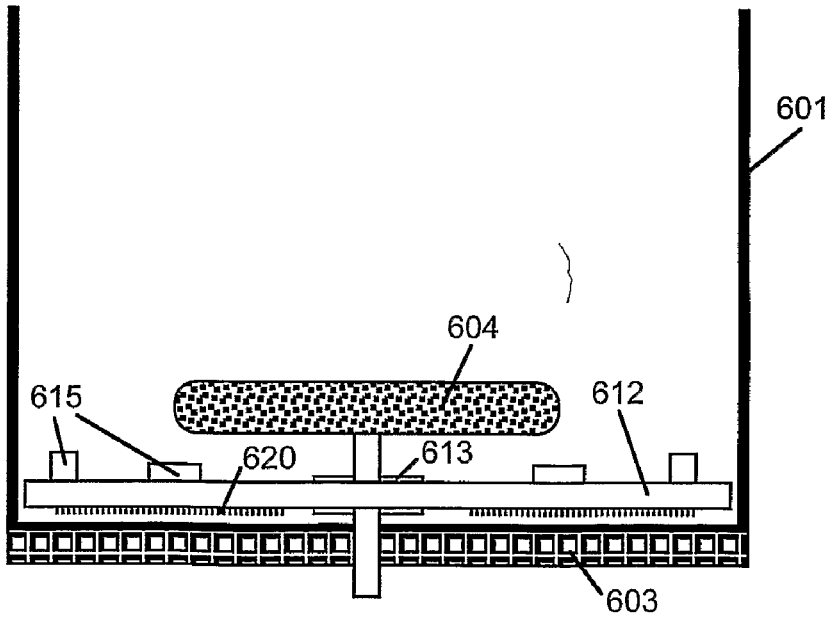
Figure 6

DRUMS FOR HOGGING APPARATUS

FIELD OF INVENTION

The present invention is directed towards reducing apparatus and particularly hogging apparatus. This is typically apparatus for reducing the size of waste wood and timber material for use as a combustible fuel source. However the present invention also describes modifications allowing it to deal more satisfactorily with fibrous materials, and a range of materials other than wood.

BACKGROUND DESCRIPTION

In the broader sense the present invention is directed to apparatus for reducing or comminuting wooden and other material into smaller sized pieces. Typically the raw feed material is waste pieces of logs, timber, or other wood based material which can then be converted into a combustible fuel source suitable for use in boilers, and the like. This is commonly known as hog fuel.

The inventor has previously described reducing apparatus in an earlier application NZ 532002 (WO2005/092509). This describes a rotatable inclined drum with an inclined reducing disc within, and seeks to provide higher quality hog fuels. However, during trials and experimentation with different materials, it was found that certain problems could sometimes arise when extending the limits of the apparatus.

These problems primarily arose when fibrous materials were present, such as certain types of vegetation, and recycled materials such as steel-belted tyres, etc. While the reducing means rapidly broke down these materials, the fibrous elements tended to accumulate within the drum rather than passing through the screening apertures. As a consequence this material would start to fill the drum, preventing new raw material from reaching the reducing means, and thus reducing the overall efficiency and throughput of the process.

In order to address these problems, and to improve the utility of the apparatus, modifications have been proposed herein. These modifications need not be restricted, however, to the apparatus of the applicant's earlier application NZ 532002. For instance it is known that the same types of problems (with fibrous and certain types of material) also affect other types of hogging apparatus. This includes tub type apparatus, where the tub is oriented substantially vertically and with the screening portions at or near the base. The applicant has proposed the use of agitators to improve screening efficiencies in these types of apparatus, in NZ patent application No. NZ532005 (published specification AU2005201329). This solution provided for agitators positioned over parts of the screen, to increase agitation and screening efficiency in these regions. However, these have limited effectiveness with fibrous materials, and their efficiencies are limited to the screen in the vicinity of the agitator.

Accordingly, it would be useful to provide an alternative solution which improves the ability of a variety of drum and tub like hoggers to deal with problematic materials, and/or improve screening efficiencies. The present invention looks at these issues.

It is therefore one object of the present invention to address at least some of the foregoing problems.

Alternatively, it is one object of the present invention to provide a drum arrangement able to more effectively deal with fibrous or lengthy type materials.

At the very least, it is an object of the present invention to provide the public with a useful alternative choice.

Aspects of the present invention will be described by way of example only and with reference to the ensuing description.

GENERAL DESCRIPTION OF THE INVENTION

According to one aspect of the present invention there is provided a drum arrangement for use in reducing apparatus, said drum arrangement comprising:

- a drum, said drum being substantially open at one end, to allow the feed of raw material therein, and bearing plurality of apertures acting as screening apertures to allow processed material of sufficiently reduced size to pass therethrough;
- said apparatus including a rotating reducing means within which reduces the size of raw material with which it comes into contact, and
- said apparatus also including a paddle arrangement, positioned within the drum, at least one of the two being rotatable relative to the other.

According to another aspect of the present invention there is provided a drum arrangement, substantially as described above, in which the paddle arrangement is substantially an open cylinder.

According to another aspect of the present invention there is provided a drum arrangement, substantially as described above, in which the paddle arrangement is substantially frame-like in appearance.

According to another aspect of the present invention there is provided a drum arrangement, substantially as described above, in which the paddle arrangement is configured such that its outer wall structure is in close proximity to the inner wall of the drum.

According to another aspect of the present invention there is provided a drum arrangement, substantially as described above, in which close proximity means 50 mm or less.

According to another aspect of the present invention there is provided a drum arrangement, substantially as described above, in which said framework comprises longitudinal elements, substantially parallel to the longitudinal axis of the paddle arrangement, which act as paddles.

According to another aspect of the present invention there is provided a drum arrangement, substantially as described above, in which between four and twenty four (inclusive) such paddles are distributed about the circumference of the framework of the paddle arrangement.

According to another aspect of the present invention there is provided a drum arrangement, substantially as described above, in which paddles are present at an end of a cylindrical paddle arrangement.

According to another aspect of the present invention there is provided a drum arrangement, substantially as described above, in which said end positioned paddles are in proximity to an end of the drum.

According to another aspect of the present invention there is provided a drum arrangement, substantially as described above, in which said end of the drum has screening apertures.

According to another aspect of the present invention there is provided a drum arrangement, substantially as described above, in which the framework of the paddle arrangement is able to support attachable screening plates which bear screening apertures.

According to another aspect of the present invention there is provided a drum arrangement, substantially as described above, in which the framework of the paddle arrangement is able to support removable screening plates which are also attachable to the drum.

According to another aspect of the present invention there is provided a drum arrangement, substantially as described above, in which the paddle arrangement is substantially two dimensional in appearance.

According to another aspect of the present invention there is provided a drum arrangement, substantially as described above, in which the paddle arrangement is substantially an open frame.

According to another aspect of the present invention there is provided a drum arrangement, substantially as described above, wherein the paddle arrangement is in close proximity to an end of the drum.

According to another aspect of the present invention there is provided a drum arrangement, substantially as described above, wherein close proximity means 100 mm or less.

According to another aspect of the present invention there is provided a drum arrangement, substantially as described above, wherein said end of the drum has screening apertures.

According to another aspect of the present invention there is provided a drum arrangement, substantially as described above, wherein the drum is substantially cylindrical.

According to another aspect of the present invention there is provided a drum arrangement, substantially as described above, in which the paddle arrangement is rotatable.

According to another aspect of the present invention there is provided a drum arrangement, substantially as described above, in which the paddle arrangement is at least partly supported by a bearing arrangement at one end.

According to another aspect of the present invention there is provided a drum arrangement, substantially as described above, in which the paddle arrangement is at least partly supported by a roller or wheel type arrangement.

According to another aspect of the present invention there is provided a drum arrangement, substantially as described above, in which the drum comprises a substantially cylindrical frame to which screening plates, which bear a plurality of said apertures acting as screening apertures, are removably attached.

According to another aspect of the present invention there is provided a drum arrangement, substantially as described above, in which said screening plates are replaceable with other screening plates having apertures of a different size, shape, or distribution.

According to another aspect of the present invention there is provided a drum arrangement, substantially as described above, in which said drum is rotatable about its central longitudinal axis.

According to another aspect of the present invention there is provided a drum arrangement, substantially as described above, in which the drum is rotatable, but the paddle arrangement remains substantially stationary.

According to another aspect of the present invention there is provided a drum arrangement, substantially as described above, in which said drum is at least partly supported by a bearing arrangement at one end.

According to another aspect of the present invention there is provided a drum arrangement, substantially as described above, in which said bearing arrangement is at a non-open end of the drum.

According to another aspect of the present invention there is provided a drum arrangement, substantially as described above, in which the drum is at least partly supported by a roller or wheel type arrangement.

According to another aspect of the present invention there is provided a drum arrangement, substantially as described above, in which both the paddle arrangement and drum are rotatable.

According to another aspect of the present invention there is provided a drum arrangement, substantially as described above, in which the paddle arrangement and drum rotate in opposite (clockwise and counter-clockwise) directions.

According to another aspect of the present invention there is provided a drum arrangement, substantially as described above, in which both the paddle arrangement and drum are more barrel shaped than cylindrical in appearance.

According to another aspect of the present invention there is provided a drum arrangement, substantially as described above, in which the drum is partly conical or frusto-conical rather than cylindrical in appearance.

According to a further aspect of the present invention there is provided reducing apparatus comprising:

a drum arrangement, as claimed in any one of the preceding claims, whose longitudinal axis is inclined to the horizontal and a rotating reducing means within the drum arrangement, said reducing means bearing a plurality of features which interact and reduce the size of raw material with which it comes into contact.

According to another aspect of the present invention there is provided reducing apparatus, substantially as described above, in which the longitudinal axis of the drum arrangement is substantially vertical.

According to another aspect of the present invention there is provided reducing apparatus, substantially as described above, in which the raw material is wood based.

According to another aspect of the present invention there is provided reducing apparatus, substantially as described above, in which the raw material comprises at least one of: soft to medium hardness rock, hard rock, recycled tyres, asphalt roading, concrete, glass, and masonry rubble.

According to another aspect of the present invention there is provided reducing apparatus, substantially as described above, in which the reducing means is substantially a disc or cylinder in shape.

According to another aspect of the present invention there is provided reducing apparatus, substantially as described above, which includes features on the reducing assembly for reducing the raw material, said features being teeth.

According to another aspect of the present invention there is provided reducing apparatus, substantially as described above, in which the rotational axis of the reducing means is angled at an angle to the longitudinal axis of the drum.

According to another aspect of the present invention there is provided reducing apparatus, substantially as described above, in which the angle of the reducing means' rotational axis, relative to the drum's longitudinal axis, is in the inclusive range of 5°-75°.

According to another aspect of the present invention there is provided reducing apparatus, substantially as described above, in which the angle of the reducing means' rotational axis, relative to the drum's longitudinal axis, is within the inclusive range of 25°-45°.

According to another aspect of the present invention there is provided reducing apparatus, substantially as described above, in which the rotational axis of the reducing means is angled, when the apparatus is viewed from the front, at an angle to the longitudinal axis of the drum.

According to another aspect of the present invention there is provided reducing apparatus, substantially as described above, in which the angle of the reducing means' rotational axis, relative to the drum's longitudinal axis when viewed from the front, is within the inclusive range of 5°-75°.

According to another aspect of the present invention there is provided reducing apparatus, substantially as described above, in which the angle of the reducing means' rotational axis, relative to the drum's longitudinal axis when viewed from the front, is within the inclusive range of 25°-45°.

According to another aspect of the present invention there is provided reducing apparatus, substantially as described above, in which the angle of the reducing means' rotational axis relative to the drum's longitudinal axis, when viewed from the front, is downward from the longitudinal axis when travelling from the end of the drum where the disc is located and towards the alternate feed end.

According to another aspect of the present invention there is provided reducing apparatus, substantially as described above, in which the disc rotates in a direction opposite the direction of rotation of either a rotating paddle arrangement or a rotating drum, as may be present.

According to another aspect of the present invention there is provided reducing apparatus, substantially as described above, in which, when viewed from the end of the drum, the reducing means is offset to the side with respect to the longitudinal axis of the drum.

According to another aspect of the present invention there is provided reducing apparatus, substantially as described above, in which there are two sections, defined as a cleaning section adjacent the feed end of the drum, and a processing section in which the reducing means is present; there being present an inward flange acting as a barrier to the passage of small material from the cleaning section to the second processing section.

According to another aspect of the present invention there is provided reducing apparatus, substantially as described above, in which said small material is typically stones, dirt, and foreign material.

According to another aspect of the present invention there is provided reducing apparatus, substantially as described above, in which there are screening apertures present in the cleaning section and in which the size of screening apertures on the cleaning section are smaller than screening apertures provided in the processing section.

According to another aspect of the present invention there is provided reducing apparatus, substantially as described above, in which the cleaning section includes a paddle arrangement, which paddle arrangement may be linked to or independent of a paddle arrangement associated with the processing section.

According to another aspect of the present invention there is provided reducing apparatus, substantially as described above, in which there is external wiping or brushing means for assisting the clearing and unblocking of foreign material from the screening apertures.

According to another aspect of the present invention there is provided reducing apparatus, substantially as described above, in which there is an associated feed mechanism for delivering raw material into the drum.

According to another aspect of the present invention there is provided reducing apparatus, substantially as described above, in which the feed mechanism is a conveyer arrangement.

According to another aspect of the present invention there is provided reducing apparatus, substantially as described above, in which there is provided at least one motive means for rotating one or more components of the drum arrangement.

According to another aspect of the present invention there is provided reducing apparatus, substantially as described above, in which the motive means is a combustion engine.

According to another aspect of the present invention there is provided reducing apparatus, substantially as described above, in which the exhaust from the combustion engine is vented into the interior of the drum to heat, and partially dry, the bulk raw material.

According to another aspect of the present invention there is provided reducing apparatus, substantially as described above, which includes clearing means for transporting screened material away from the apparatus.

According to another aspect of the present invention there is provided reducing apparatus, substantially as described above, in which the clearing means comprises conveying means able to deliver transported material into a hopper, trailer, or storage area.

According to another aspect of the present invention there is provided reducing apparatus, substantially as described above, which includes both conveying feed means and clearing means, the conveying feed means positioned to be substantially over lower clearing means.

According to another aspect of the present invention there is provided reducing apparatus, substantially as described above, which is mounted onto a trailer or vehicle.

According to another aspect of the present invention there is provided reducing apparatus, substantially as described above, which is a hogger.

For the purposes of simplicity, the term 'cylindrical' will generally be used throughout this specification for describing the general shape of the inner and drums. However it is envisaged that alternate shapes may also be used, including barrel type shapes, part conical and frusto-conical type shapes, and more complicated shapes defining a three dimensional shape with internal volume. When the term 'cylindrical' is used in relation to the paddle arrangement and drums, these other configurations should also be borne in mind as possible equivalents and substitutes for a 'pure' cylinder.

The present invention comprises two general aspects—a modified drum arrangement for use in reducing apparatus, and reducing apparatus incorporating such a modified drum arrangement. The modified drum arrangements will be discussed first, then followed by a discussion of possible reducing apparatus.

In the simplest form the drum arrangement of the present invention comprises a paddle arrangement and drum. These should have longitudinal and/or rotational axes which are substantially coaxial, as it is intended that there should be rotation of at least one relative to the other. It is also desirable that at least paddle like components on the paddle arrangement, and drum, be in close proximity. For simplicity we shall talk generally of the instance where the paddle arrangement is positioned within the drum, though this need not be the case in all embodiments—in some embodiments the paddle arrangement may be outside the drum, or both inside and outside the drum.

Typically, close proximity is gauged by the distance between the outer surface of the paddle arrangement and an inner surface of the drum (assuming the paddle arrangement is within the drum, as will be assumed to be the case herein unless otherwise stated). While this distance is preferably less than 100 mm, more preferably less than 50 mm, and ideally less, consideration needs to be given to the nature of the material being processed, and the screening size—one wishes to avoid unscreened particles jamming between the paddle arrangement and drum. Hence one variation is to include brushes or wipers between the drums to remove, or prevent the entry of, material between the drums.

There are two main configurations for a paddle arrangement which shall be discussed within this specification, though it should be envisaged that variations and modifications are possible. The two primary categories are 3-dimensional, and 2-dimensional paddle arrangements. The 3-dimensional arrangements are typically cylindrical in nature, though generally resemble the general shape of the drum. For simplicity we shall refer to these as being cylindrical in the description, noting that other shapes may be substituted.

Two dimensional forms are usually circular or disc-like in appearance. Where the 3-dimensional forms typically interact with screening apertures on the side (as opposed to ends) of a cylindrical drum, the two dimensional forms usually act on screening apertures provided at an end of the drum. The 2-dimensional forms need not be circular in plan, but may also adopt other shapes—for instance, star shaped, radial spokes from a central hub, square, polygonal, irregular polygonal, ellipsoid, etc. Neither do they need to be purely 2-dimensional—for instance it may be dished, or have protrusions from one or both faces (such as to increase agitation), etc. These forms are regarded as 2 dimensional as they are relatively flat as compared to the 3-dimensional forms—these just being convenient labels for categorising different embodiments of paddle arrangements of the present invention.

It should also be appreciated that 3-dimensional forms of the paddle arrangement may also include provision for interacting with an end screen on the drum. A 3-dimensional form may also act solely on an end screen (such as where the drum does not possess side screens), as there can be advantage in agitating the contents of the drum at a level above or away from end screening apertures. Hence, embodiments having features or characteristics of the afore-described 2-dimensional and 3-dimensional forms of a paddle arrangement are within the scope of the present invention.

In preferred arrangements, though the preferred arrangements also allow for other configurations to be adopted, the drum bears a plurality of screening apertures which screen reduced material and allow it to pass through. While these apertures may be formed in the drum itself, the preferred arrangement is for the drum to comprise an open framework to which screening plates are attachable. These screening plates bear the screening apertures allowing reduced material to pass through.

This option can offer some significant advantages. For instance, damaged screening plates can be removed for repair or replacement. Screening plates with differently sized or shaped apertures, or different distributions, may also be substituted to alter the nature of the screened product.

Another advantage is that the outer screening plates can be removed entirely, and screening plates fitted to the paddle arrangement (or other modifications made) such that the paddle arrangement becomes the screening drum, and the framework of the drum acts as a paddle arrangement to assist clearing material from screen apertures. This option provides another means of addressing difficult materials, as well as converting the apparatus for use in the manner of previous application NZ 532002. In a preferred embodiment, the screening plates for the drum are attachable to the paddle arrangement. A further option also existing for providing screening apertures on both the paddle arrangement and drums.

Preferably, except when the arrangement has been altered to provide screening apertures on the paddle arrangement, the paddle arrangement is a substantially open framework. In a 3-dimensional type paddle arrangement this preferably includes a plurality of substantially longitudinal oriented elements (i.e. substantially parallel to the longitudinal axis of the drum) which effectively act as paddles or wipers for material held within the drum—i.e. when there is relative rotation between the paddle arrangement and the drum. This wiping action allows for a clearing of screening apertures which may be blocked by certain materials. The increased agitation in the vicinity of the screening apertures also helps increase the rate of material passing through the apertures. For certain materials, particularly items like wire, the change in orientation promoted by agitation makes it more likely for the material to pass through. For materials such as steel and ferromagnetic alloys, an external electromagnet can be used to separate screened material, and may help in drawing material through (though this later option depends also upon the type of materials chosen for the construction of the drums).

Preferably, at most points along the longitudinal axis of the (3-dimensional) paddle arrangement, a cross-section will show the presence of between four and twenty four (inclusive) longitudinal elements. This may vary along the length of the paddle arrangement. Similarly, numbers of longitudinal elements outside of this range may be considered and employed.

The paddle arrangement may differ in length from that of the drum. This may be the case for at least one embodiment of hogging apparatus described later, which includes an initial pre-screening section. As a variation, a separate paddle arrangement could be provided in the pre-screening stage. This may be coupled or linked to the paddle arrangement in a processing stage, or independent thereof.

The configuration of 2-dimensional paddle arrangements are typically circular or disc-like. For convenience of manufacture, paddles/wipers will be arranged radially. As the distance from the centre increases, the number of paddles may be increased—particularly on larger paddle arrangements. However, different arrangements may be adopted. Protrusions extending from a top and/or bottom face may be provided to further enhance agitation within the drum, as well as providing a wiping type effect in the vicinity of the screening apertures.

Such 2-dimensional types will typically have a central or rotational axis which is coaxial with the longitudinal axis of the drum. This tends to make manufacture simpler, though arrangements (for both 2-dimensional and 3-dimensional embodiments) exist in which the axis of the paddle arrangement is offset from that of the drum. However, care needs to be taken with such embodiments that jamming does not occur as the distances between rotating parts decreases.

At least one of the paddle arrangement and drum should be rotatable to allow relative rotation between the two. Both may be rotatable, either rotating in opposite directions and/or at different rotational speeds. They may be supported by a bearing arrangement at one end, though wheel and roller type arrangements may also be employed, as well as combinations of techniques.

In reducing apparatus the drum arrangement is generally inclined relative to the horizontal, and in some cases may be substantially vertical (though these are typically for embodiments having end screens). However this will be more fully described in the following description of preferred reducing apparatus employing the drum arrangement of the present invention.

Reducing apparatus according to the present invention comprises a drum arrangement such as described above. This drum arrangement typically has a substantially cylindrical internal volume and allows a quantity of raw unprocessed material to be held at any given time. Further, it also allows this material to be fed towards reducing means which is responsible for breaking down the raw material into smaller sized pieces.

To achieve this the drum arrangement is generally inclined with respect to the horizontal. For embodiments with side screening apertures they are typically inclined such that the longitudinal axis of the drum is typically inclined at an angle within the inclusive range 5°-45°, and more preferably within the inclusive range of 15°-30°. The direction of inclination is such that a first end of the drum, which is typically open and represents a means for raw material to be fed into the drum arrangement, is at the upper end, while the reducing means which is positioned at or near the other end of the drum, is at the lower end. As one or more of the drums of the drum arrangement rotate relative to their longitudinal axis, this inclination is effective for gradually progressing raw material from the feed end towards the reducing means.

It will also be seen later that not all material will be sufficiently reduced in size when it first makes contact with reducing means. Accordingly some of this material will be thrown at least partially back up the drum, where the drum arrangement's inclination will gradually re-feed it to the reducing means.

The drum arrangement has been described as possessing a plurality of apertures which act as a screening apertures to allow sufficiently small materials to pass therethrough. The size of these apertures may be substantially constant, though they may also very in size according to various distribution patterns about the apparatus. For instance, where side screening apertures are provided the size of the apertures may reduce as one progresses towards the feed (upper) end, allowing for smaller reduced material which may be thrown further up the apparatus to be removed from within the drum as soon as possible. The size, variations, and distribution patterns of the screening apertures will to a large effect be dependent on user choice, and influence the average sized material which will be removed from the system.

While the reducing means may take a number of different forms (including rotating drums), the preferred arrangement is a rotating disk. Ideally this has a majority of teeth or projections on its exposed front face though will typically also comprise teeth or other projections about its circumferential edge, and possibly also behind. Accordingly, a majority of the processing of raw material will be performed preferentially by the front face, though the circumferential edge will also perform significant processing on some of the raw material.

The rotation of reducing means taking the form of a disk may vary according to user choice. There may be some advantage in directing the rotational direction opposite to that of the drum arrangement so as more forcefully interact with raw material being rotated and driven towards it. Additionally it can be more likely to throw material back up the drum where it may be more effectively screened by apertures not obscured by a build up of raw unprocessed material. Larger material will also be re-presented to the rotating disk in a different orientation, which may improve processing efficiency.

In preferred embodiments of the present invention the disk is also angled in a number of ways. When the apparatus is viewed from above, the disk may be angled with respect to the longitudinal axis of the drum. In a preferred embodiment the difference in the rotational axis of the disk to the longitudinal axis of the drum is within the inclusive range of 5° through 75°. More preferably, in preferred embodiments, this difference is within the inclusive range of 25° through 45°.

The disk may also be inclined in other directions as well. For instance if we viewed the reducing apparatus from the front, such that we are viewing the side of the drum arrangement rather than an end thereof, the disk may also be inclined relative to the longitudinal axis of the drum. The difference between the rotational axis and longitudinal axis may again be within the inclusive range of 5° through 75° inclusive, though more preferably within the smaller inclusive range of 25° through 45°. Ideally, when viewed from the front, an inclined disk will be such that its lower most edge is closer to the open feed end of the drum arrangement than will be its topmost edge.

By appropriately angling and positioning the disk it is envisaged that only a portion of the disk will be presented in any one time (unless drum is overloaded) with raw material waiting to be processed, and that at least a portion of partially processed material will be flung further back up the drum where it has the opportunity to be screened before being reintroduced to the rotating disk.

A further problem affecting hogging apparatus is the presence of foreign material. Not only does steel in rocks pose a problem, but also non combustible material such as dirt, clay, small stones etc. A simple modification has been proposed for some embodiments which will improve the separation and removal of such material from the bulk raw material.

It is proposed that in some embodiments the drum is divided into sections. The manner of forming a boundary between the sections can be the presence of an inwardly directed flange extending from the inner face of the drum. The height of this flange from the drum surface may be relatively shallow as we do not wish to form a total dam to the progress of material. Where drums are inclined substantially vertically, the amount by which the flange extends inwardly may be substantially more.

In shallow flange embodiments the height of the flange from the inner drum surface may only comprise 5-10% of the diameter of the drum though this may very according to the type of material typically being processed. It is envisaged in preferred embodiments that this barrier will typically be of 25-250 mm in height, and typically in the range 40-100 mm.

This sectioning into what will be conveniently described as an initial cleaning section, and subsequent processing section, can be further improved if agitation apparatus is also introduced into the cleaning section. The agitation apparatus in the cleaning section may be more vigorous in nature and serve to knock and wipe foreign material such as dirt, small stones, and clay etc which may be attached to bulk material being fed into the apparatus. It is also envisaged that the inward flange will act as a barrier to prevent this removed small material from travelling into the second section while the larger bulk material will have no real difficulty in progressing through the apparatus. The majority of foreign material will then be able to exit via apertures provided in the cleaning section. These apertures may be of a smaller size than in the subsequent processing section, so as to only allow this typically smaller foreign material to pass through and to be suitably removed after exit from the apparatus.

As some of this material may be wet and sticky, and may clog screening apertures associated with the cleaning section, wiping or brush like means may be provided to help clear these apertures. Typically this may be provided on the outside of the apparatus for convenience, and to avoid damage thereto by the bulk material.

Typically the apparatus will require motive means to drive rotation of the reducing means and the drum. Various types of motive means, and more than one motive means, may be employed. However it is envisaged that in most cases a combustion engine, typically a diesel engine, will be relied upon to drive the apparatus. When such motive means are used, an additional advantage may be realised. Such combustion engines have an exhaust which comprises a significant amount of heat. By suitable venting of these exhaust gases to within the interior of the drum, the bulk material can be heated. In the situation where the raw material is damp or wet, this can provide a useful drying effect which in turn increases the true calorific output of the resulting fuel, and hence its value to the operator.

Exhaust gases may be introduced in a number of ways. Perhaps the simplest way which is proposed by the inventor is to introduce a shaft from along at least part of the length of the drum and which has a number of apertures therein which allow the venting of exhaust gases inside the drum. The size and position of the exhaust gases may be varied to either give a substantially even output of exhaust gases along its route, or to concentrate the release of exhaust gases where they are able to do the most good. This may be where the greatest concentration or bulk of processed materials lies (i.e. in the vicinity of reducing means). However, in embodiments where there is a cleaning section, enhanced drying in this section may improve subsequent processing as well as improving the removal of wet dirt, clay, and similar types of foreign material.

The apparatus may also include feed means to feed raw material within the drum. In a preferred embodiment a dual conveyor system is incorporate which allows delivery of bulk material into the apparatus, as well as removal of comminuted material. Various arrangements may be considered, and may also be catered for by an independent existing conveying system.

The apparatus may be constructed to sit on the ground or, as in one embodiment to be described later, mounted on a trailer so that a mobile unit is obtained.

DESCRIPTION OF DRAWINGS

Different aspects of the invention will be described with reference to the accompanying drawings in which:

FIG. 5 is a partial cut-away side view of a vertical drum type embodiment of the present invention, FIG. 6 is a partial cut-away side view of an alternative vertical drum type embodiment of the present invention.

DESCRIPTION OF PREFERRED EMBODIMENT

Figure 1:
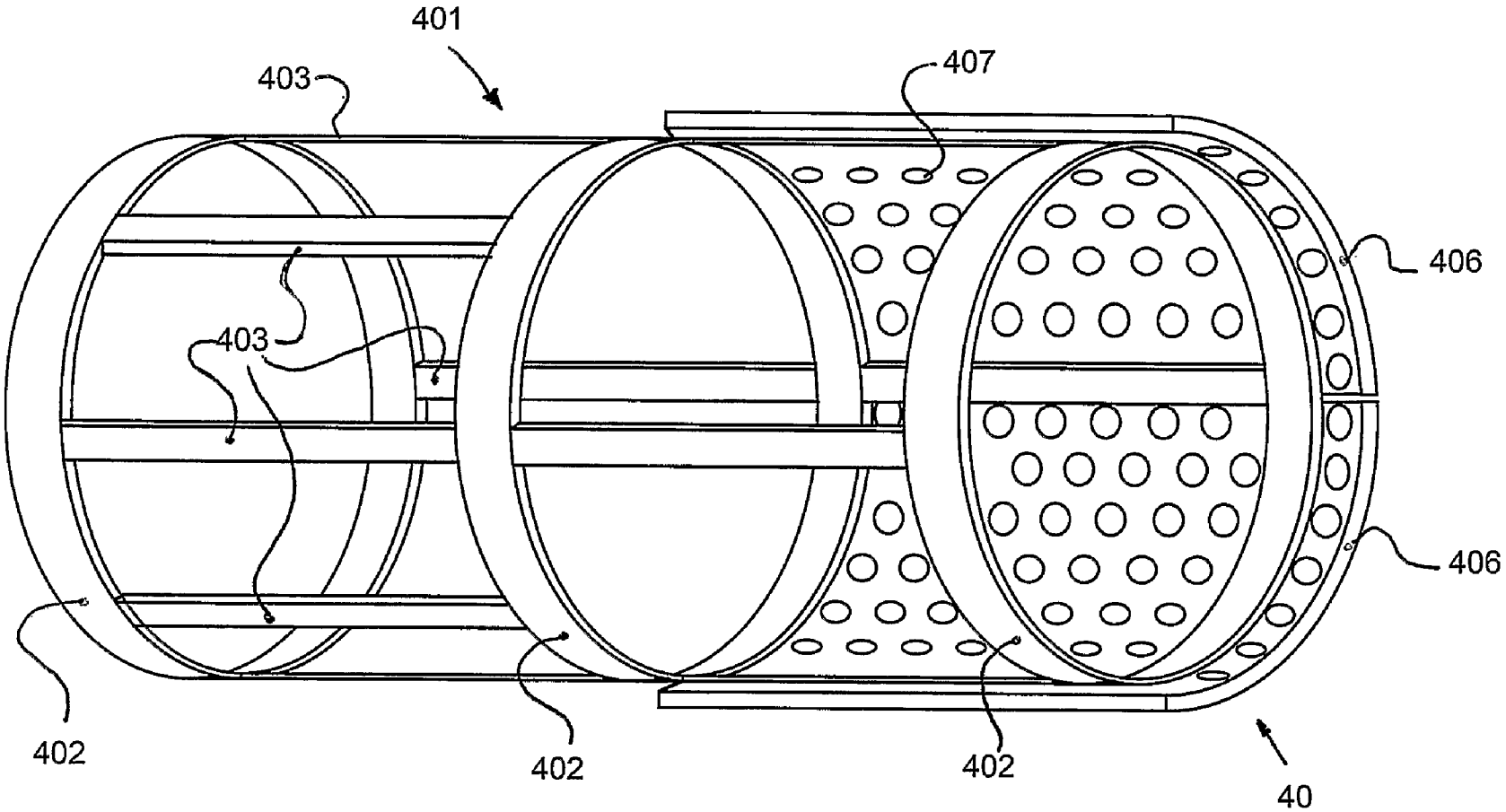
FIG. 1 is a partial cut-away perspective view of a drum arrangement according to the present invention.

With reference to the drawings and by way of example only there is provided a drum arrangement for use in reducing apparatus. This comprises a paddle arrangement (generally indicated by arrow 401). The paddle arrangement is substantially an open framework made up of a plurality of circumferential elements (402) and longitudinal elements (403) though only some are shown for clarity in the drawing. The paddle arrangement is driven and rotates relative to the drum (40). The drum (40) comprises a substantially similar framework (not visible) to that of the paddle arrangement (401). However, here the elements of the frame support screening plates (406) with screening apertures (407) therein. These plates (406) are removable and typically of a steel material.

Figure 2:
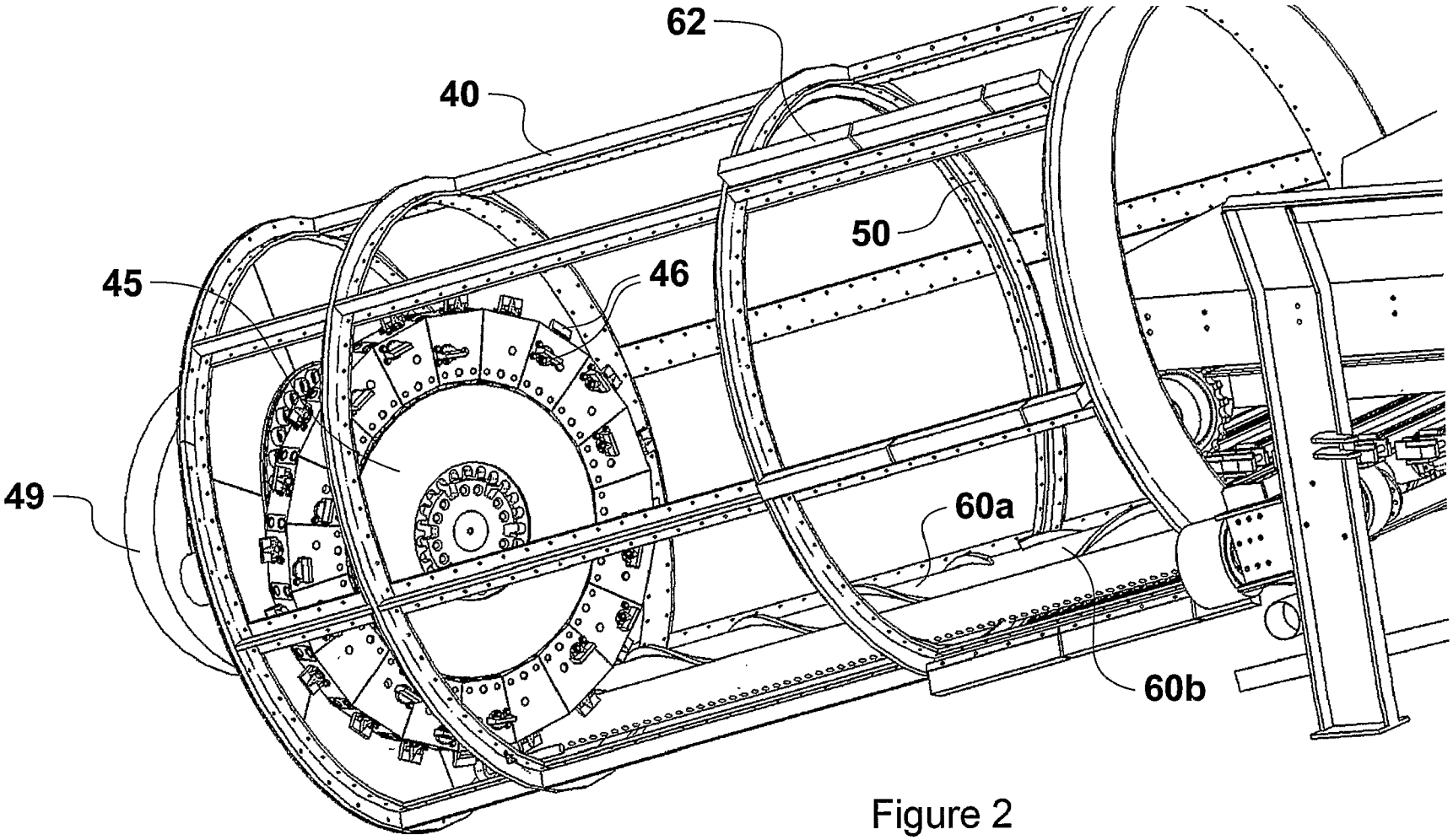
FIG. 2 is a front cut-away perspective view of the drum portion (only drum shown for simplicity) of a preferred embodiment of reducing apparatus according to the present invention.

Reducing apparatus employing the drum arrangement of FIG. 1 is illustrated in FIG. 2, though here only the drum (40) with screening plates removed is shown for clarity. The paddle arrangement can have a very similar structure to the frame of the drum, though with decreased dimensions. This can reduce tooling and manufacturing costs.

Figure 3:
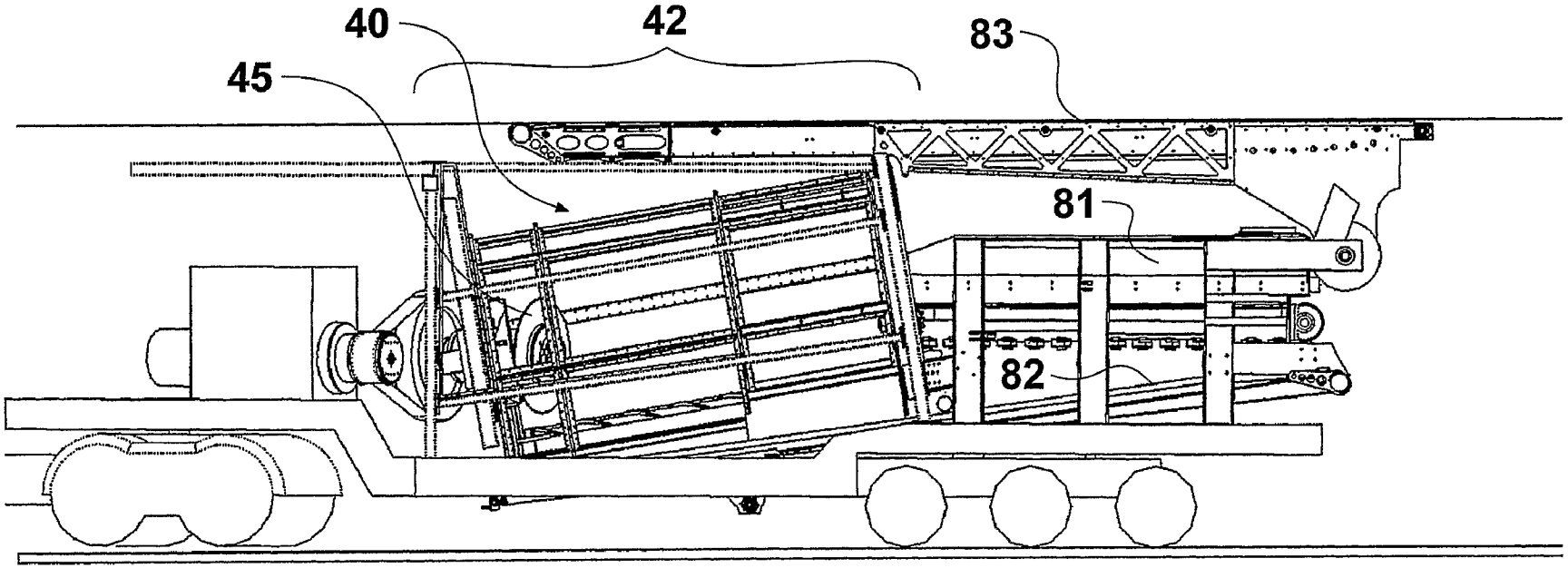
FIG. 3 is a front full view of a variation of the embodiment of FIG. 2 when mounted on a trailer, with some portions cut-away for clarity.

FIG. 3 illustrates reducing apparatus (generally indicated by section 42) as part of mobile apparatus including feed and removal means (to be discussed more fully later). In FIG. 3 the inclination of the drum (40)—coaxial with the paddle arrangement—from the horizontal, is shown. In this figure bulk material is fed from the right hand side into the apparatus.

Positioned at the lower end of the drum, and on the inside, is a rotating disk assembly (45) with a plurality of teeth (46) about its periphery. These may be fixed and/or swinging teeth (as known in the industry) The disk (45) is inclined in a number of manners. The disk is angled with respect to the horizontal axis of the drum (40). Mounting means (48) for holding the disk (45), and also transmitting drive from pulley (49) is also visible in FIG. 4. In FIG. 3 it can also be seen that the disk (45) is also angled downwardly with respect to the longitudinal axis of the drum (40). This angling corresponds to the deviation of the longitudinal axis of the drum (40) from the nominal horizontal (i.e. the ground), i.e. an angle of around 10°.

Figure 4:
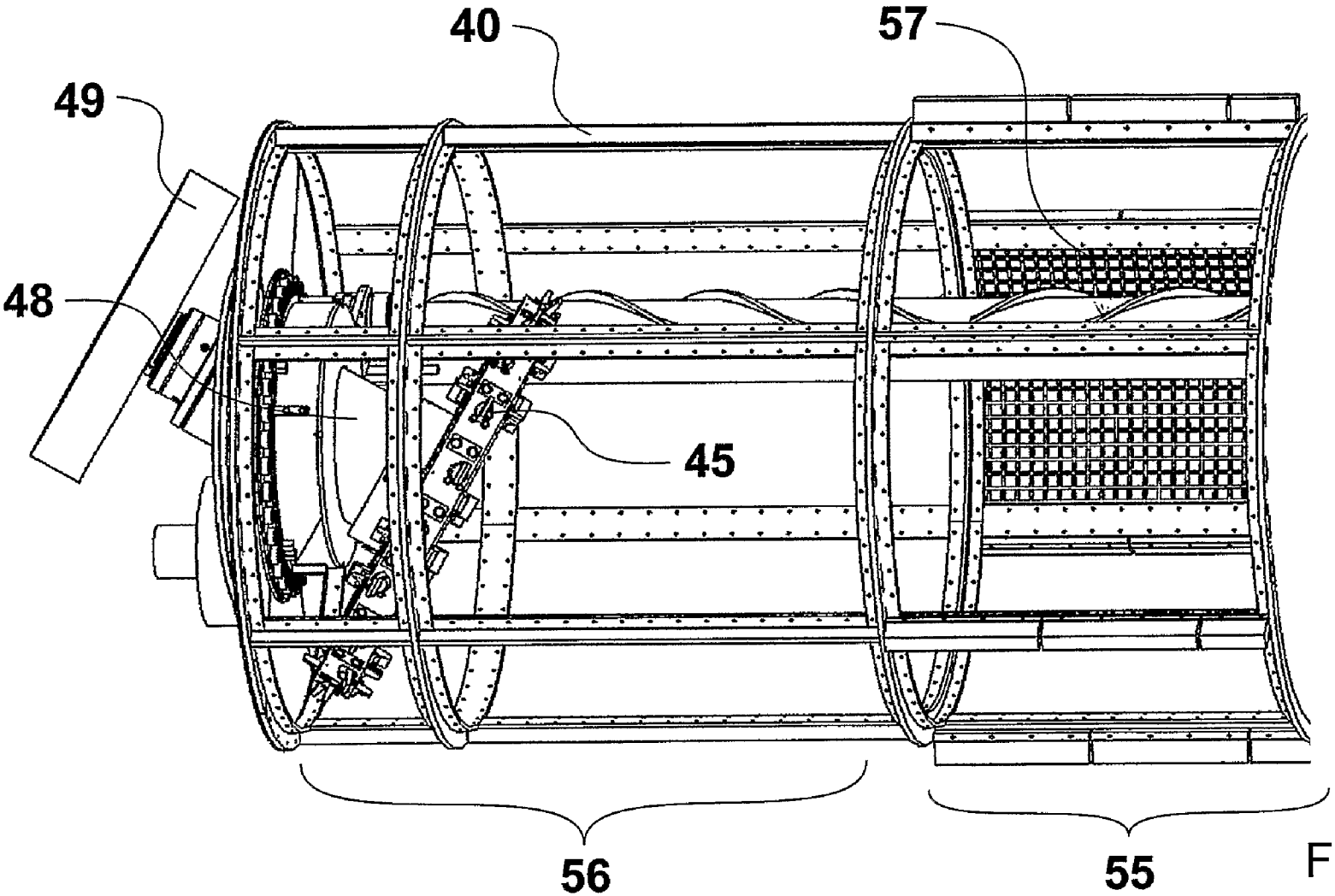
FIG. 4 is a top plan cut-away view of the drum portion of the embodiment of FIG. 3.

In the pre-screening embodiment of FIG. 4, the interior of the drum (40) is divided into two sections by the inwardly directed flange (50). This extends by a height of approximately 50 mm inwardly of the inner surface of the drum. This section divides the drum into an initial cleaning section (55) and main processing section (56). The paddle arrangement (401) is positioned within the processing section (56).

In practice, new unprocessed material as it enters the drum (40), will have a significant amount of dirt and foreign material shaken from it as it falls into the drum. The inwardly directed flange (50) acts as a barrier to prevent the majority of this material from entering into the subsequent processing section (56). Ideally there is a rotating paddle arrangement (relative to the drum) also present in this section (55). This helps promote a majority of the foreign dirt material will fall through the screen (57) associated with the cleaning section (55).

In practice bulk material which finds its way into the processing section (56) will ultimately come into contact with the rotating disk (45). At this time reduction or comminution of at least part of the bulk material will occur. Typically also, the rotation of the disk will attempt to fling the processed material upwards and further up the drum towards the opening. This has a tendency to present the flung material against relatively clear sections of grate before it tumbles towards the bottom of the drum. This material, as it finds its way back down to the bottom end of the drum will, due to the rotational motion of the paddle arrangement, typically follow a shark toothed or saw-tooth type pattern of movement if its path is traced from a view point at the front of the apparatus (e.g. FIG. 3). This motion tends to continually represent reduced material to fresh screening apertures to ensure that it has every possibility of escaping through the screen/grate if it is of sufficiently reduced size. This also reduces the possibility of large oversized material from continuously blocking the screen and thus preventing removal of the reduced size pieces. Additionally also, this tumbling motion within the apparatus continually re-orientates the various pieces of material. This can improve the screening process, as well as continually re-presenting the material to the rotating disk (45) at different orientations, which may improve overall efficiency.

To assist loading and unloading of material into the apparatus, a dual conveyor system, generally indicated by arrow (80), has been proposed. This comprises an upper conveyor system (81) which feeds bulk material into the drum (40). Collecting screened material from underneath the apparatus is a secondary conveyor system (82) which feeds a loading conveyor (83) which can deliver screened material into a suitable hopper (85). The secondary conveying system (82) extends under substantially the entire length of the drum (40).

The entire apparatus may be mounted on suitable trailer (88) which enables it to be moved from site to site. It is also envisaged that fixed, stationary embodiments may also be provided according to the present invention.

In practice raw material is loaded onto other conveyor (81). Typically this may be by excavator bucket, or front end loader bucket, or by grapple. This largely depends on the nature of the material being loaded. It is also possible that a conveyor system which leads onto feed conveyor (81) might be used in some embodiments.

Bulk material is then fed into the drum (40) (when looking down the drum towards the disk) where it progresses through the cleaning section (55) and to processing section (56). As it encounters the rotating disc—typically from the left when looking down the drum towards the disc which is rotating anti-clockwise—it encounters the teeth and part of the material will be flung to the right and against the screen of the drum (40). Suitably reduced material may fall free at this stage or during further tumbling action due to the drum and counter-clockwise rotating agitating means, which also acts to force product further up the drum towards the feed end.

As material of suitably reduced size is produced and screened from the drum, it finds its way onto a lower conveyor (82). It is possible that additional screens and guides may be used to guide the material exiting from the screens of at least the processing section to fall onto lower conveyor system (82). Additionally, shielding associated with the cleaning section (55) may be provided to prevent foreign matter and material from falling onto the lower conveyor (82). Such additional external screens and guides may in fact divert removed material in the cleaning section to either side of the conveyor.

As the conveyor (82) removes reduced material from underneath the drum, it feeds it to further optional conveying means (83) which is able to load the material onto the back of a truck or hopper.

Figure 7:
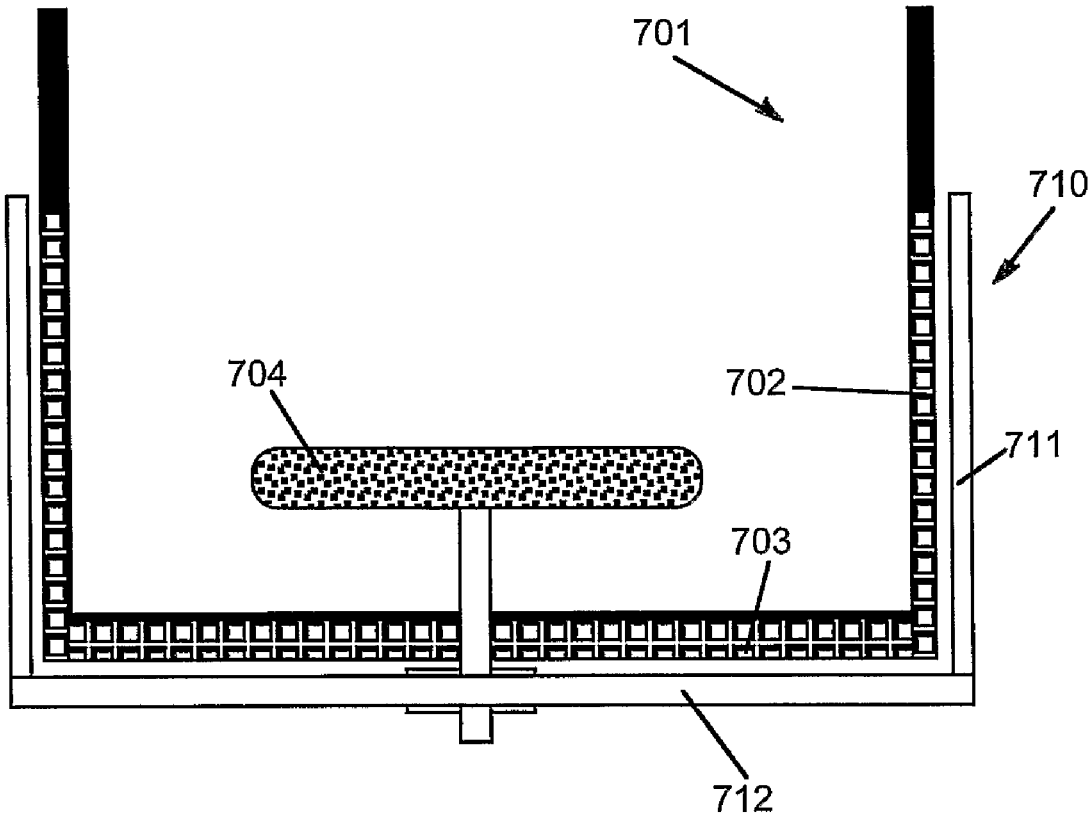
FIG. 7 is a partial cut-away side view of yet a different vertical drum type embodiment of the present invention.

FIGS. 5 through 7 illustrate a vertically inclined type drum hogger, which is representative of many tub type hoggers in use today. It is envisaged that the principles of the present invention may also be applied to such hoggers.

In FIG. 5 is shown hogger apparatus (500) comprising a cylindrical or tub type drum (501) with an open top, and which is vertically inclined. Part (502) of the sides comprise screening apertures, as does a portion (503) of the bottom/end. A reducing disc (504) acts on raw material fed into the drum (501) from the top.

Situated within the drum (501) is a paddle arrangement (510) comprising an open framework similar to that shown in FIG. 1. The sides (511) of the paddle arrangement comprise a plurality of vertical longitudinal members, roughly defining the side of a cylinder (though would match the shape of the drum (501). The base (512) of the paddle arrangement (510) comprise a plurality of radially disposed elements extending outwardly from a central supporting hub (513). This can be coupled to a motor (not shown) by a suitable supporting drive shaft, though may derive power from the drive shaft (514) for the reducing means (504), though typically there will be a gear reduction to reduce the rotational speed of the paddle arrangement (510) relative to the reducing disc (504). The paddle arrangement (510) is able to sweep over, and in close proximity to, screening apertures provided on the drum (501) to assist in clearing same and increasing removal efficiency.

Inward features (515) may be provided to increase agitation and mixing of the raw material within the drum (501).

FIG. 6 illustrates a variation where the paddle arrangement (610) is substantially 2-dimensional and disc-like. As for the embodiment of FIG. 5, the paddle arrangement which interacts with screening apertures (603) on the base of the drum (601), may comprise a radial array of longitudinal elements extending outwardly from a central hub (613). In many respects the paddle arrangement may resemble a wooden cart-wheel of old.

The paddle arrangement (610) may also bear upward features to increase agitation of raw material in the drum (601). Also optionally provided are wiper brushes (or flexible blades) (620) to help clear foreign or fibrous materials from screening apertures (603). The reducing disc (604) and associated arrangement options may be as for the embodiment of FIG. 5.

FIG. 7 shows a variation of the FIG. 5 embodiment, where the paddle arrangement (710) is on the outside of the drum (701). The drum still includes screening apertures (702, 703) as per the embodiment of FIG. 5. The construction of the paddle arrangement (710), its sides (711) and bottom (712) are also equivalent to the general construction of the embodiment of FIG. 5. This embodiment works similar to that of FIG. 5, though with less agitation of raw material within the drum. However it is more effective at helping pull material from the screening apertures (702, 703), which can be beneficial for some fibrous and other materials.

A variation of this embodiment may also be proposed, which includes the outer paddle arrangement of FIG. 7, as well as the paddle arrangement of FIG. 5. The paddle arrangements may rotate or be coupled together, or exhibit different motions (e.g. different rotational speeds, direction, etc.

It should also be noted that the paddle arrangements in FIGS. 5 through 7 (and this may be applied to the embodiments of FIGS. 1 through 4 also) need not perform a continuous rotational movement relative to the drum. Instead a repeated cycle of rotation in one direction, followed by reverse rotation, may be used—similar to the cycle in many agitator washing machines.

Aspects of the present invention have been described by way of example only and it should be appreciated that modifications and additions may be made thereto without departing from the spirit or scope of the present invention as described herein.

It should also be understood that the term "comprise" where used herein is not to be considered to be used in a limiting sense. Accordingly, 'comprise' does not represent nor define an exclusive set of items, but includes the possibility of other components and items being added to the list.

This specification is also based on the understanding of the inventor regarding the prior art. The prior art description should not be regarded as being authoritative disclosure on the true state of the prior art but rather as referencing considerations brought to the mind and attention of the inventor when developing this invention.

I claim:

1. A drum arrangement for use in reducing apparatus, said drum arrangement comprising:

a drum of substantially cylindrical, barrel shaped, frusto-conical, or conical configuration, said drum being substantially open at one end, to allow the feed of raw material therein; the curved side walls of the drum bearing a plurality of apertures acting as screening apertures to allow processed material of sufficiently reduced size to pass therethrough;

said apparatus including a rotating reducing means within which reduces the size of raw material with which it comes into contact, and said apparatus also including a paddle arrangement of a configuration substantially the same as that of said drum; both the drum and paddle arrangement being substantially coaxial about their longitudinal axes; said paddle arrangement being positioned such that its side wall structure is close to screening apertures on the drum; and wherein at least one of said drum and paddle arrangement are rotatable about their longitudinal axes relative to the other.

2. A drum arrangement as claimed in claim 1 in which the paddle arrangement is substantially an open-ended cylinder.

3. A drum arrangement as claimed in claim 2 in which the paddle arrangement is an open framework, in which said framework comprises longitudinal elements, substantially parallel to the longitudinal axis of the paddle arrangement, which act as paddles.

4. A drum arrangement as claimed in claim 3 in which the paddle arrangement is within the drum and configured such that its outer wall structure is in close proximity to the inner wall of the drum, and in which close proximity means 50 mm or less.

5. A drum arrangement as claimed in claim 3 in which between four and twenty four (inclusive) such paddles are distributed about the circumference of the framework of the paddle arrangement.

6. A drum arrangement as claimed in claim 3 in which the framework of the paddle arrangement is able to support attachable screening plates which bear screening apertures.

7. A drum arrangement as claimed in claim 6 in which the framework of the paddle arrangement is able to support removable screening plates which are also attachable to the drum.

8. A drum arrangement as claimed in claim 1 in which the paddle arrangement is rotatable, and in which the paddle arrangement is at least partly supported by a bearing arrangement at one end.

9. A drum arrangement as claimed in claim 8 in which the paddle arrangement is at least partly supported by a roller or wheel arrangement.

10. A drum arrangement as claimed in claim 1 in which the drum comprises a substantially cylindrical frame to which screening plates, which bear a plurality of said apertures acting as screening apertures, are removably attached.

11. A drum arrangement as claimed in claim 10 in which said screening plates are replaceable with other screening plates having apertures of a different size, shape, or distribution.

12. A drum arrangement as claimed in claim 1 in which the drum is rotatable, but the paddle arrangement remains substantially stationary.

13. A drum arrangement as claimed in claim 12 in which said drum is at least partly supported by a bearing arrangement at one end.

14. A drum arrangement as claimed in claim 13 in which said bearing arrangement is at a non-open end of the drum.

15. A drum arrangement as claimed in claim 13 in which the drum is at least partly supported by a roller or wheel.

16. A drum arrangement as claimed in claim 13 in which both the paddle arrangement and drum are rotatable.

17. A drum arrangement as claimed in claim 16 in which the paddle arrangement and drum rotate in opposite (clockwise and counter-clockwise) directions.

18. Reducing apparatus comprising:

a drum arrangement, as claimed in claim 1, whose longitudinal axis is inclined to the horizontal, and at least one motive means for rotating one or more components of the drum arrangement, wherein the reducing means is substantially a disc or cylinder in shape.

19. Reducing apparatus as claimed in claim 18 in which the longitudinal axis of the drum arrangement is substantially vertical.

20. Reducing apparatus as claimed in claim 18 in which the raw material is wood based.

21. Reducing apparatus as claimed in claim 18 in which the raw material comprises at least one of: soft to medium hardness rock, hard rock, recycled tires, asphalt roading, concrete, glass, and masonry rubble.

22. Reducing apparatus as claimed in claim 18, wherein the reducing means includes teeth.

23. Reducing apparatus as claimed in claim 18 in which the rotational axis of the reducing means is angled at an angle to the longitudinal axis of the drum.

24. Reducing apparatus as claimed in claim 23 in which the angle of the reducing means' rotational axis, relative to the drum's longitudinal axis, is within the inclusive range of 25°-45°.

25. Reducing apparatus as claimed in claim 23 in which the rotational axis of the reducing means is angled, when the apparatus is viewed from the front, at an angle to the longitudinal axis of the drum.

26. Reducing apparatus as claimed in claim 25 in which the angle of the reducing means' rotational axis, relative to the drum's longitudinal axis when viewed from the front, is within the inclusive range of 25°-45°.

27. Reducing apparatus as claimed in claim 18 in which the reducing means rotates in a direction opposite the direction of rotation of either a rotating paddle arrangement or a rotating drum, as may be present.

28. Reducing apparatus as claimed in claim 18 in which, when viewed from the end of the drum, the reducing means is offset to the side with respect to the longitudinal axis of the drum.

29. Reducing apparatus as claimed in claim 18 in which there is an associated feed mechanism for delivering raw material into the drum.

30. Reducing apparatus as claimed in claim 29 in which the feed mechanism is a conveyer arrangement.

31. Reducing apparatus as claimed in claim 18 in which the motive means is a combustion engine.

32. Reducing apparatus as claimed in claim 18, in which reduced material is screened by passing through screens about either or both of the drum or paddle arrangement of the drum arrangement, and which includes clearing means for transporting screened material away from the apparatus.

33. Reducing apparatus as claimed in claim 32 in which the clearing means comprises conveying means able to deliver transported material into a hopper, trailer, or storage area.

34. Reducing apparatus as claimed in claim 18 which is mounted onto a trailer or vehicle.

* * * * *